US011600411B2

(12) United States Patent
Tonouchi

(10) Patent No.: US 11,600,411 B2
(45) Date of Patent: Mar. 7, 2023

(54) TERMINAL CONNECTING STRUCTURE AND ELECTRONIC COMPONENT

(71) Applicant: KOA Corporation, Nagano (JP)

(72) Inventor: Isao Tonouchi, Nagano (JP)

(73) Assignee: KOA Corporation, Nagano (JP)

( * ) Notice: Subject to any disclaimer, the term of this patent is extended or adjusted under 35 U.S.C. 154(b) by 0 days.

(21) Appl. No.: 17/474,759

(22) Filed: Sep. 14, 2021

(65) Prior Publication Data

US 2022/0084727 A1 Mar. 17, 2022

(30) Foreign Application Priority Data

Sep. 17, 2020 (JP) ..... JP2020-156249

(51) Int. Cl.
*H01C 7/12* (2006.01)
*H01C 7/112* (2006.01)

(52) U.S. Cl.
CPC ..... *H01C 7/12* (2013.01); *H01C 7/112* (2013.01)

(58) Field of Classification Search
CPC . H01C 7/12; H01C 7/102; H01C 1/14; H01C 1/148; H01T 1/16
See application file for complete search history.

(56) References Cited

U.S. PATENT DOCUMENTS 4,959,505 A * 9/1990 Ott ..... H01G 2/06 338/21
5,990,779 A * 11/1999 Katsuki ..... H01C 1/1406 338/234
6,316,726 B1 * 11/2001 Hidaka ..... H01G 4/228 257/696
6,489,880 B2 * 12/2002 Miyazaki ..... H01C 1/01 338/315
6,690,258 B2 * 2/2004 Katsuki ..... H01C 1/1406 338/315
7,852,192 B2 * 12/2010 Yu ..... H01C 1/1406 338/315
9,679,683 B2 * 6/2017 Su ..... H01C 1/1406

FOREIGN PATENT DOCUMENTS

JP 02156508 * 6/1990
WO 2011162181 A1 12/2011

OTHER PUBLICATIONS

JP02156508 (same as JP63-311108), machine translation. (Year: 1990).*

* cited by examiner

*Primary Examiner* — Kyung S Lee
(74) *Attorney, Agent, or Firm* — Honigman LLP

(57) ABSTRACT

A terminal connecting structure is provided with each of the electrodes provided on the element forming the electronic component; and the terminals respectively having the connecting portions arranged along the electrodes respectively. In addition, the terminal connecting structure is provided with clearance forming portions configured to respectively form the respective clearances between the electrodes and the connecting portions respectively; and the connecting materials respectively provided in the clearances, the connecting material being configured to electrically connect the connecting portions and the electrodes respectively.

7 Claims, 8 Drawing Sheets

TERMINAL CONNECTING STRUCTURE AND ELECTRONIC COMPONENT

CROSS-REFERENCE TO RELATED APPLICATIONS

This application claims priority of Japanese Patent Application No. JP 2020-156249 filed on Sep. 17, 2020, the contents of which are incorporated herein.

TECHNICAL FIELD

The present disclosure relates to a terminal connecting structure and an electronic component.

BACKGROUND ART

In recent years, there have been drastic changes in usage environments for electronic components used for automobiles, household electrical appliances, industrial equipment, etc. There has been revisions of the standards, which had not been requested so far, for the electronic components of these kinds. In addition, the applications of the components have been increasingly diversified for the electronic components of these kinds. As a result, in order to protect fragile electronic circuits from unexpected noise or pulse with large energy, requirements for the electronic components to be mounted on the equipment have become quite severe. A varistor that is used as a component for protecting the circuit is an electronic component formed of a voltage surge absorber. There are the varistors of a disk type, a surface mounted type, and a laminated (inner layer) type, and they are used depending on the application. WO 2011/162181 discloses a surface mounted type varistor. This varistor includes a varistor element, and electrodes are respectively formed on front and back surfaces of the varistor element.

A terminal is connected to each of the electrodes, and the electrode and the terminal are bonded by using a solder.

SUMMARY

In general, the bulk size of the varistors is increased for the higher voltage/larger current type. With the recent development in space saving and size reduction for the electronic components, a surface mounted varistor capable of coping with the high voltage/large current pulse is required. However, even if the bulk size of a conventional surface mounted varistor is increased for the high voltage/large current pulse, when the varistor is short circuited by a pulse caused by lightning surge, etc., the component itself is heated to about 1000° C. In a terminal connecting structure in such electronic components, if a used amount (supplied amount, filled amount) of a connecting material formed of a solder for electrically connecting the electrode and the terminal is small, a suitable bonding strength cannot be ensured.

In addition, if an excessive amount of the connecting material is used, the thickness dimension of the solder becomes excessive, and there is a risk in that the terminal or the element is exposed from an outer package. In addition, there is a problem that it leads to the excessive increase in a product size and an increase in a cost.

As described above, if the thickness of the connecting material is varied, a variation in the bonding strength of the bonded portion will be caused.

Thus, an object of the present invention is to enable suppression of problems due to a used amount of a connecting material connecting a terminal and an electrode.

According to an aspect of the present invention, a terminal connecting structure includes: an electrode provided on an element forming a component; and a terminal having a connecting portion arranged along the electrode. In addition, the terminal connecting structure includes: a clearance forming portion configured to form a clearance between the electrode and the connecting portion; and the connecting material provided in the clearance, the connecting material being configured to electrically connect the connecting portion and the electrode.

According to this aspect, the clearance is formed between the connecting portion of the terminal and the electrode by the clearance forming portion, and a variation of the used amount of the connecting material for electrically connecting the connecting portion and the electrode is suppressed by the clearance.

Therefore, compared with a case in which a predetermined clearance cannot be ensured between the electrode and the terminal, and thus, the used amount of the connecting material provided between the electrode and the terminal may be varied for every connection (i.e., for every individual item or lot), it becomes possible to suppress problems due to the amount of the connecting material used for connecting the terminal and the electrode.

DESCRIPTION OF EMBODIMENTS

First Embodiment

Figure 1:
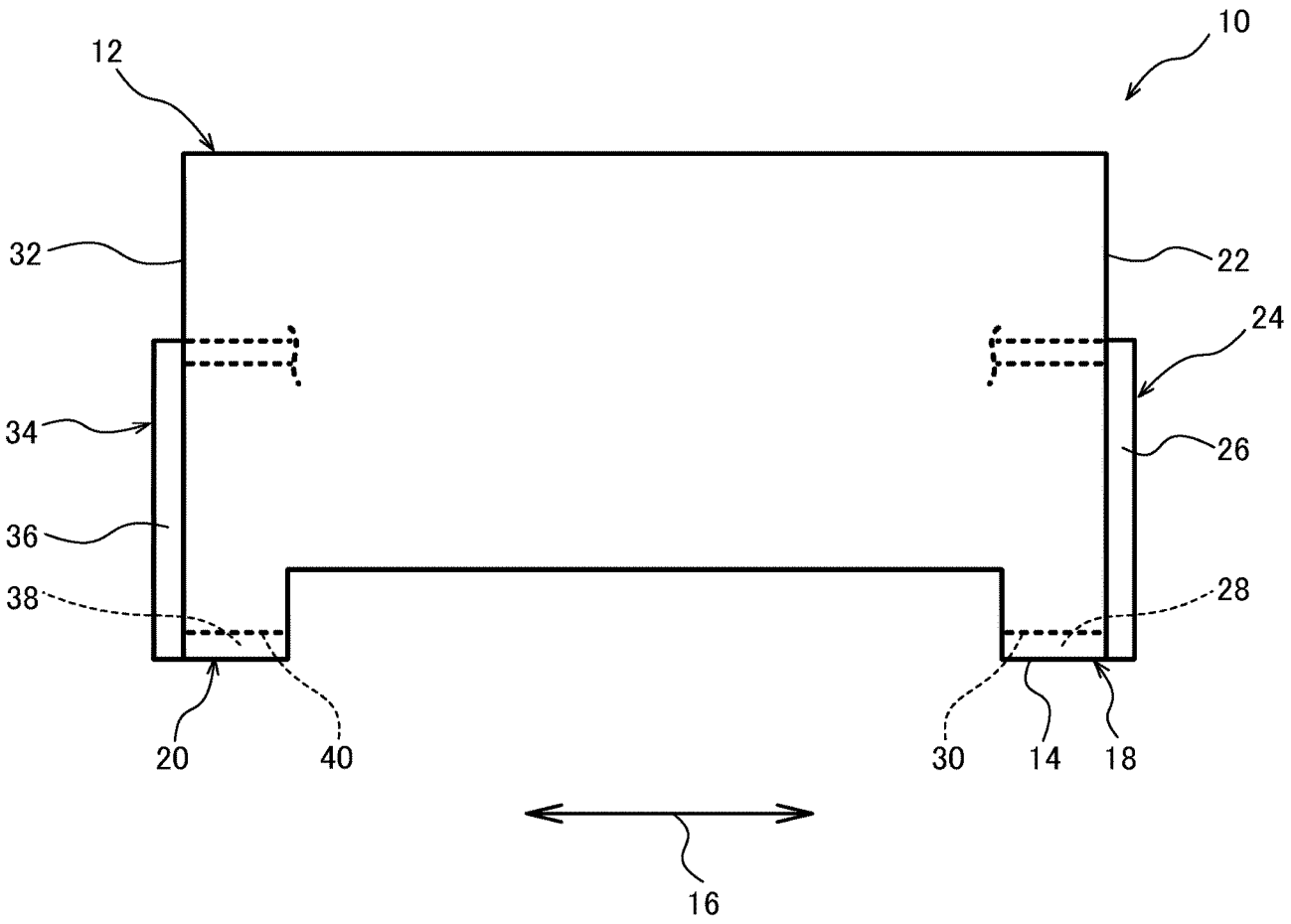
FIG. 1 is a side view showing an electronic component according to a first embodiment.

An electronic component provided with a terminal connecting structure according to a first embodiment will be described with reference to FIGS. 1 to 3. FIG. 1 is a side view showing an electronic component 10 according to the first embodiment.

The electronic component 10 includes a varistor, a resistor, a capacitor, a thermistor, a semiconductor, or various types of sensor elements, or the like to which these components are applied. In this embodiment, a case in which the electronic component 10 is the varistor will be described as an example. The varistor is the electronic component 10 having a pair of metal terminals in which a ceramic element is sandwiched between the metal terminals, and has a durability capable of tolerating usage environments in which a high voltage and large current, such as lightning surge, etc., for example, are applied.

The electronic component 10 is provided with a component main body 12 having a rectangular shape, for example. The component main body 12 is formed of a molding resin, etc. for sealing the ceramic element for exhibiting functions of the varistor inside. A first leg portion 18 that projects downward from one end portion in the longitudinal direction 16 and a second leg portion 20 that projects downward from other end portion in the longitudinal direction 16 are formed on a bottom surface 14 of the component main body 12.

A first terminal 24 forming a first metal terminal extends out from a first end surface 22 on the one side of the longitudinal direction 16 of the component main body 12. The first terminal 24 is, for example, formed of copper or iron so as to have a plate shape, and nickel or tin is plated on the surface thereof.

A part of the first terminal 24 extended from the component main body 12 is bent so as to follow the first end surface 22 of the component main body 12, and the first terminal 24 has a first extended portion 26 extending along the first end surface 22. The tip end side of the first extended portion 26 is folded over towards the center part of the component main body 12 in the longitudinal direction 16, and a first tip end portion 28 extending out from the first extended portion 26 is arranged in a first recessed portion 30 formed in the first leg portion 18.

In addition, a second terminal 34 forming a second metal terminal extends out from an second end surface 32 on the other side of the longitudinal direction 16 of the component main body 12. The second terminal 34 is, for example, formed of copper or iron so as to have a plate shape, and nickel or tin is plated on the surface thereof.

A part of the second terminal 34 extended from the component main body 12 is bent so as to follow the second end surface 32 of the component main body 12, and the second terminal 34 has a second extended portion 36 extending along the second end surface 32. The tip end side of the second extended portion 36 is folded over towards the center part of the component main body 12 in the longitudinal direction 16, and a second tip end portion 38 extending out from the second extended portion 36 is arranged in a second recessed portion 40 formed in the second leg portion 20.

Figure 2:
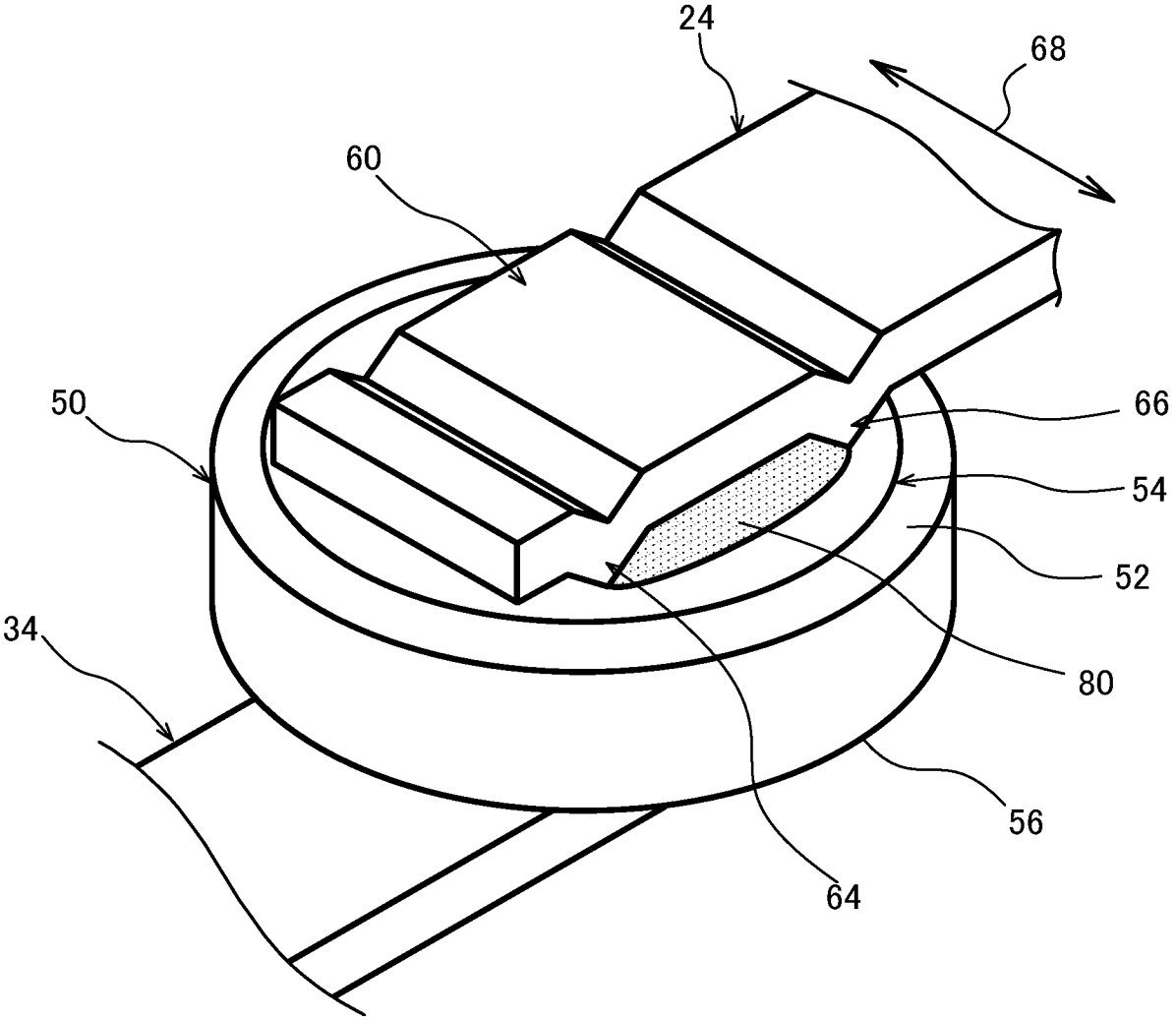
FIG. 2 is a perspective view showing inside of the electronic component according to the first embodiment.
Figure 3:
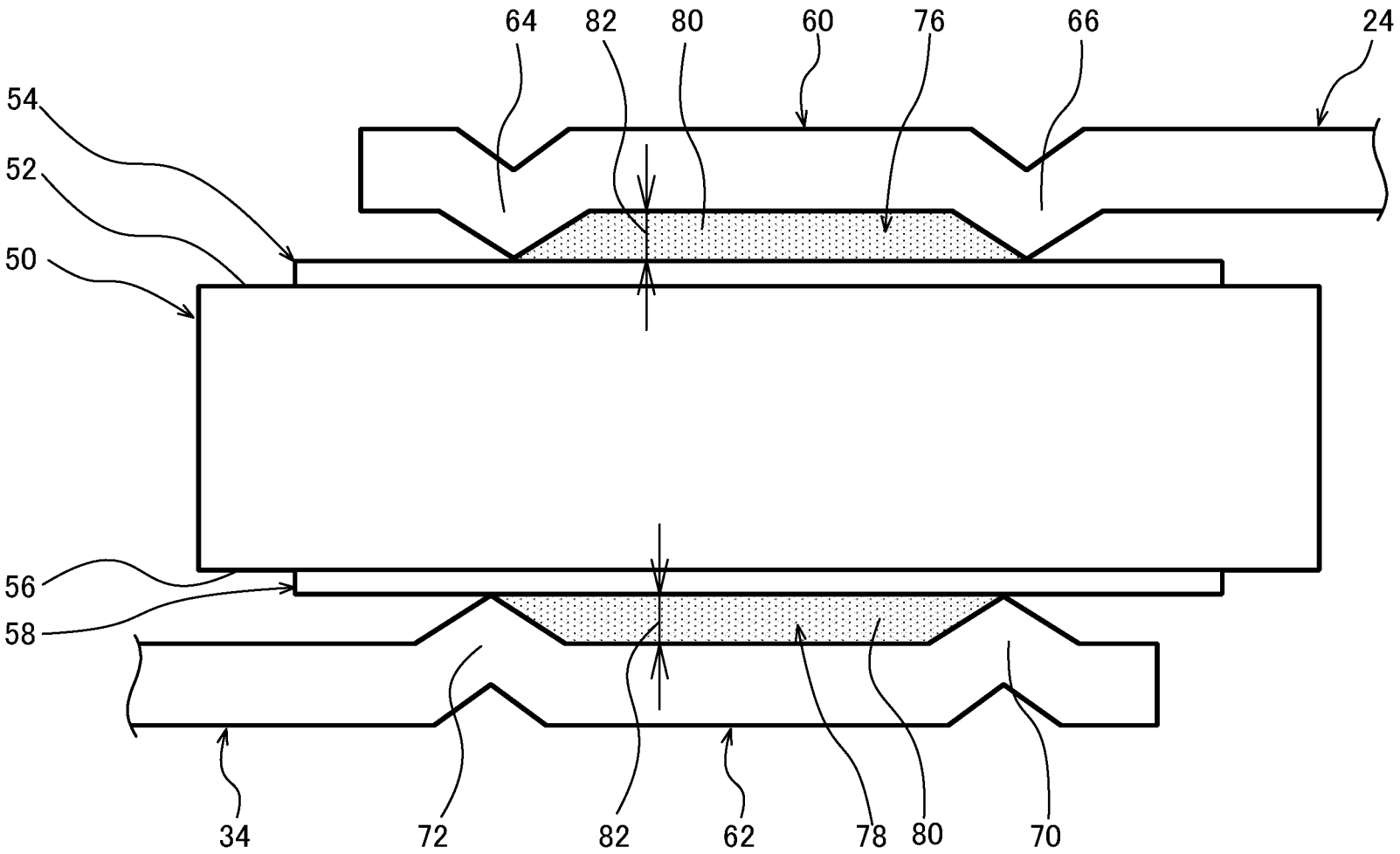
FIG. 3 is a side view showing the inside of the electronic component according to the first embodiment.

FIG. 2 is a perspective view showing the inside of the electronic component 10 according to the first embodiment, and FIG. 3 is a side view showing the inside of the electronic component 10 according to the first embodiment.

An element 50 forming the electronic component 10 is provided in the component main body 12, and the element 50 forming the electronic component 10 includes an active element and passive element. In this embodiment, the varistor is used as the electronic component 10, and the ceramic element, which is the passive element, is used as the element 50. Therefore, the ceramic element that is composed by mixing additive to zinc oxide (ZnO), for example, and that forms the varistor is provided in the component main body 12.

The element 50 is formed to have a cylinder shape or a prism shape. A first surface 52 forming a first end of the element 50 is provided with a first electrode 54, and a second surface 56 forming a second end of the element 50 is provided with a second electrode 58 (see FIG. 3).

The electrodes 54, 58 are each formed by a screen printing or an application, for example, and the electrodes 54, 58 are each formed of a silver based material or a silver-palladium based material, for example. The first electrode 54 is fixed by being brought into close contact with the first surface 52, and the second electrode 58 is fixed by being brought into close contact with the second surface 56 (see FIG. 3).

The first electrode 54 is formed to have a circular shape smaller than the outer diameter dimension of the first surface 52, and a part of the first surface 52 having a circular ring shape is exposed at an outer circumferential portion of the first electrode 54. The second electrode 58 is formed to have a circular shape smaller than the outer diameter dimension of the second surface 56, and a part of the second surface 56 having a circular ring shape is exposed at an outer circumferential portion of the second electrode 58.

An end portion of the first terminal 24 that extends into the inside of the component main body 12 forms a first connecting portion 60 that is arranged so as to extend along, so as to be in parallel with, the first electrode 54. In addition, an end portion of the second terminal 34 that extends into the inside of the component main body 12 forms a second connecting portion 62 that is arranged so as to extend along, so as to be in parallel with, the second electrode 58 (see FIG. 3).

As shown in FIG. 3, the first connecting portion 60 of the first terminal 24 has been subjected to a press work, and thereby, the tip end side of the first connecting portion 60 is formed with a first tip-end projected portion 64 that projects towards the first electrode 54 by being pressed by the press work so as to form a V shape. In addition, the base end side of the first connecting portion 60 that is closer to the first extended portion 26 than from the tip end side of the first connecting portion 60 is formed with a first base-end projected portion 66 that projects towards the first electrode 54 by being pressed by the press work so as to form a V shape.

The first tip-end projected portion 64 and the first base-end projected portion 66 are each formed by a ridge crossing the first terminal 24 in the width direction, and the first tip-end projected portion 64 and the first base-end projected portion 66 extend in the crossing direction 68 in a straight line (see FIG. 2). The ridges forming the first tip-end projected portion 64 and the first base-end projected portion 66 are each formed to have a triangular shape when viewed from the side.

As shown in FIG. 3, the second connecting portion 62 of the second terminal 34 has been subjected to the press work, and thereby, the tip end side of the second connecting portion 62 is formed with a second tip-end projected portion 70 that projects towards the second electrode 58 by being pressed by the press work so as to form a V shape. In addition, the base end side of the second connecting portion 62 that is closer to the second extended portion 36 than from the tip end side of the second connecting portion 62 is formed with a second base-end projected portion 72 that projects towards the second electrode 58 by being pressed by the press work so as to form a V shape.

The second tip-end projected portion 70 and the second base-end projected portion 72 are each formed by the ridge crossing the second terminal 34 in the width direction, and the second tip-end projected portion 70 and the second base-end projected portion 72 extend in the crossing direction 68 in a straight line. The ridges forming the second tip-end projected portion 70 and the second base-end projected portion 72 are each formed to have the triangular shape when viewed from the side.

In the above description, in this embodiment, although a case in which each of the projected portions 64, 66, 70, 72 is formed by the ridge having the triangle shape when viewed from the side will be described, the present invention is not limited thereto, and each of the projected portions 64, 66, 70, 72 may be formed by the ridge having a trapezoid shape when viewed from the side. In addition, the pointing apex of the triangle shape of the ridge when viewed from the side may have a rounded shape.

As shown in FIG. 3, the first tip-end projected portion 64 and the first base-end projected portion 66 are brought into contact with a surface of the first electrode 54, and the first tip-end projected portion 64 and the first base-end projected portion 66 form a clearance forming portion that forms a first clearance 76 between the first electrode 54 and the first connecting portion 60. The second tip-end projected portion 70 and the second base-end projected portion 72 are brought into contact with a surface of the second electrode 58, and the second tip-end projected portion 70 and the second base-end projected portion 72 form the clearance forming portion that forms a second clearance 78 between the second electrode 58 and the second connecting portion 62.

A connecting material 80 for electrically connecting the first electrode 54 and the first connecting portion 60 is provided in the first clearance 76 that is formed between the first electrode 54 and the first connecting portion 60. The connecting material 80 for electrically connecting the second electrode 58 and the second connecting portion 62 is provided in the second clearance 78 that is formed between the second electrode 58 and the second connecting portion 62.

The connecting material 80 includes a conductive resin (an adhesive) or a solder, and in this embodiment, a case in which the connecting material 80 is formed of the solder will be described as an example.

When the connecting portions 60, 62 of the respective terminals 24, 34 are electrically connected to the corresponding electrodes 54, 58, respectively, the connecting materials 80 formed of the solder are respectively arranged between the connecting portions 60, 62 and the respective corresponding electrodes 54, 58. In this state, for example, a soldering iron is pressed against the connecting portions 60, 62 of the respective terminals 24, 34 to heat the connecting portions 60, 62, thereby melting the connecting materials 80. Next, pressure is applied to the connecting portions 60, 62 by using the soldering iron until the projected portions 64, 66, 70, 72 of the respective connecting portions 60, 62 respectively come to contact with the respective corresponding electrodes 54, 58. A know technique can be employed as a connection method.

By doing so, the molten connecting materials 80 are each filled into each of the clearances 76, 78, and thereby, the connecting portions 60, 62 of the respective terminals 24, 34 are electrically connected to the respective electrodes 54, 58, respectively.

In addition, it is possible to maintain distances from back surfaces of the connecting portions 60, 62 to respective corresponding front surfaces of the electrodes 54, 58 at a constant distance. With such a configuration, the used amount of the connecting materials 80 to be filled into the respective clearances 76, 78 between the connecting portions 60, 62 and the respective corresponding electrodes 54, 58 is suitably controlled. In addition, the thickness dimensions 82 of the connecting materials 80 to be connected to the respective corresponding electrodes 54, 58 of the respective connecting portions 60, 62 are maintained at a prescribed dimension.

Next, the element 50 to which the terminals 24, 34 have been connected is covered by the molding resin to form the component main body 12 as shown in FIG. 1.

Operations and Effects

Next, operational advantages of the first embodiment will be described.

The terminal connecting structure in this embodiment is provided with: the electrodes 54, 58 each provided on the element 50 forming the electronic component 10; and the terminals 24, 34 respectively having the connecting portions 60, 62 that are arranged along the electrodes 54, 58, respectively. In addition, the terminal connecting structure is provided with: the clearance forming portions configured to form the clearances 76, 78 between the electrodes 54, 58 and the connecting portions 60, 62, respectively; and the connecting materials 80 respectively provided in the clearances 76, 78, the connecting materials 80 being configured to electrically connect the connecting portions 60, 62 and the electrodes 54, 58, respectively.

According to such a configuration, the clearances 76, 78 are respectively formed by the clearance forming portions between the connecting portions 60, 62 of the respective terminals 24, 34 and the respective corresponding electrodes 54, 58. With each of the clearances 76, 78, it is possible to control the thickness of the connecting material 80 so as to be constant by suppressing variation of the used amount (filled amount) of the connecting material 80 for electrically connecting each of the connecting portions 60, 62 to the corresponding electrode 54, 58.

In the above, if a predetermined clearance cannot be ensured between the electrode and the terminal, the used amount of the connecting material to be provided between the electrode and the terminal may be varied for every connection (i.e., for every individual item or lot). However, in this embodiment, compared with such a case, it is possible to suppress problems due to the used amount of the connecting material 80 for connecting the terminals 24, 34 and the electrodes 54, 58, respectively.

In addition, it is possible to control the used amount of the connecting material 80 to a suitable level without performing a complex process control for controlling the used amount of the connecting material 80.

In the above, when the terminals 24, 34 and the electrodes 54, 58 are connected, respectively, with the solder serving as the connecting material 80, an alloy layer is formed at portions where the solder comes to contact with metals contained in each of the electrodes 54, 58, and thereby, the terminals 24, 34 are bonded to the electrodes 54, 58, respectively. The alloy layer is harder and less resistive against stress relative to the solder. Thus, if the thickness dimension 82 of a solder layer formed of the solder is small, detachment is likely to be caused at a bonded portion between the terminals 24, 34 and the electrodes 54, 58, respectively.

In contrast, in this embodiment, by suppressing the variation of the amount of the solder serving as the connecting material 80 for connecting the terminals 24, 34 and the electrodes 54, 58, respectively, it is possible to maintain the thickness dimension 82 of the solder layer formed with the solder at a prescribed dimension. Thus, in the solder layer, a solder region, which is softer than the alloy layer, can be ensured to be larger than a certain area, and therefore, it is possible to suppress formation of a crack.

On the other hand, the thermal stress applied to the bonded portion between each of the terminals 24, 34 and each of the electrodes 54, 58 due to temperature change is increased along with the increase in the thickness dimension of the solder layer. Therefore, if the thickness dimension of the solder layer is varied so as not to fall within a predetermined range, a bonding strength of the bonded portion to the thermal stress is varied.

Especially, when the electronic component 10 is the varistor, the electronic component 10 is heated to about 1000° C. by a large current caused when the lightning surge, etc. is input. Therefore, the variation in the bonding strength to the thermal stress has a large influence on the durability of the electronic component 10.

Thus, in this embodiment, by suppressing the variation in the thickness dimension 82 of the solder layer, it is possible to suppress the variation in the bonding strength of the bonded portion between each of the terminals 24, 34 and each of the electrodes 54, 58 and to improve the durability of the electronic component 10 against the temperature change.

In addition, in this embodiment, the clearance forming portion includes each of the projected portions 64, 66, 70, 72 projecting out from each of the connecting portions 60, 62.

According to such a configuration, by forming the projected portions 64, 66, 70, 72 on the connecting portions 60, 62, respectively, it is possible to respectively form the clearances 76, 78 between the connecting portions 60, 62 and the respective corresponding electrodes 54, 58.

The projected portions 64, 66, 70, 72 each functions as a barrier for suppressing wetting and spreading of the solder serving as the connecting material 80 over the whole surface of each of the electrodes 54, 58, and thereby, the thickness dimension 82 of the solder layer is ensured. Because the thickness dimension 82 of the solder layer is ensured, the solder region, which is softer than the alloy layer, can be ensured to be larger than a certain area in the solder layer, and therefore, the durability against a heat cycle is improved.

In addition, because the projected portions 64, 66, 70, 72 forming the clearance forming portions can be integrally formed with the respective connecting portions 60, 62, it is possible to achieve simplification of the configuration.

Furthermore, as described in this embodiment, because the projected portions 64, 66, 70, 72 can be formed on the respective terminals 24, 34 by the press work, it is possible to perform the processing easier.

In addition, in this embodiment, each of the projected portions 64, 66, 70, 72 includes the ridge formed so as to cross each of the terminals 24, 34.

According to such a configuration, it is possible to control an area to be filled with the connecting material 80 by the ridges respectively crossing the terminals 24, 34. Therefore, it is possible to more accurately control the used amount of the connecting material 80. In addition, it is possible to stably connect the terminals 24, 34 to the electrodes 54, 58, respectively, in parallel.

Also with the electronic component 10 according to this embodiment, the above described operational advantages can be achieved.

In addition, in the electronic component 10 in this embodiment, the electrodes 54, 58 include the first electrode 54 provided on the first surface 52 of the element 50 and the second electrode 58 provided on the second surface 56 of the element 50. In addition, the terminals 24, 34 include the first terminal 24 electrically connected to the first electrode 54 and the second terminal 34 electrically connected to the second electrode 58.

According to such a configuration, the distance from the first terminal 24 to the first electrode 54 and the distance from the second terminal 34 to the second electrode 58 can be maintained at the same distance, and they can be connected to the both surfaces 52, 56 of the element 50 in a parallel manner, and therefore, it is possible to prevent a short circuit of the element 50 due to the lightning surge, etc. In addition, it is possible to suppress the problems due to the used amount of the connecting material 80 for connecting the terminals 24, 34 to the respective electrodes 54, 58, and it is possible to form the electronic component 10 in which the element 50 is sandwiched by the electrodes 54, 58.

Furthermore, in the electronic component 10 in this embodiment, the element 50 is the ceramic element forming the varistor.

According to such a configuration, it is possible to form the varistor provided with the ceramic element.

In the first embodiment, although a case in which the projected portions 64, 66, 70, 72 provided on the respective terminals 24, 34 are in contact with the respective corresponding electrodes 54, 58 has been described, the configuration is not limited thereto. For example, the electronic component may be configuration as shown in a second embodiment.

Second Embodiment

Figure 4:
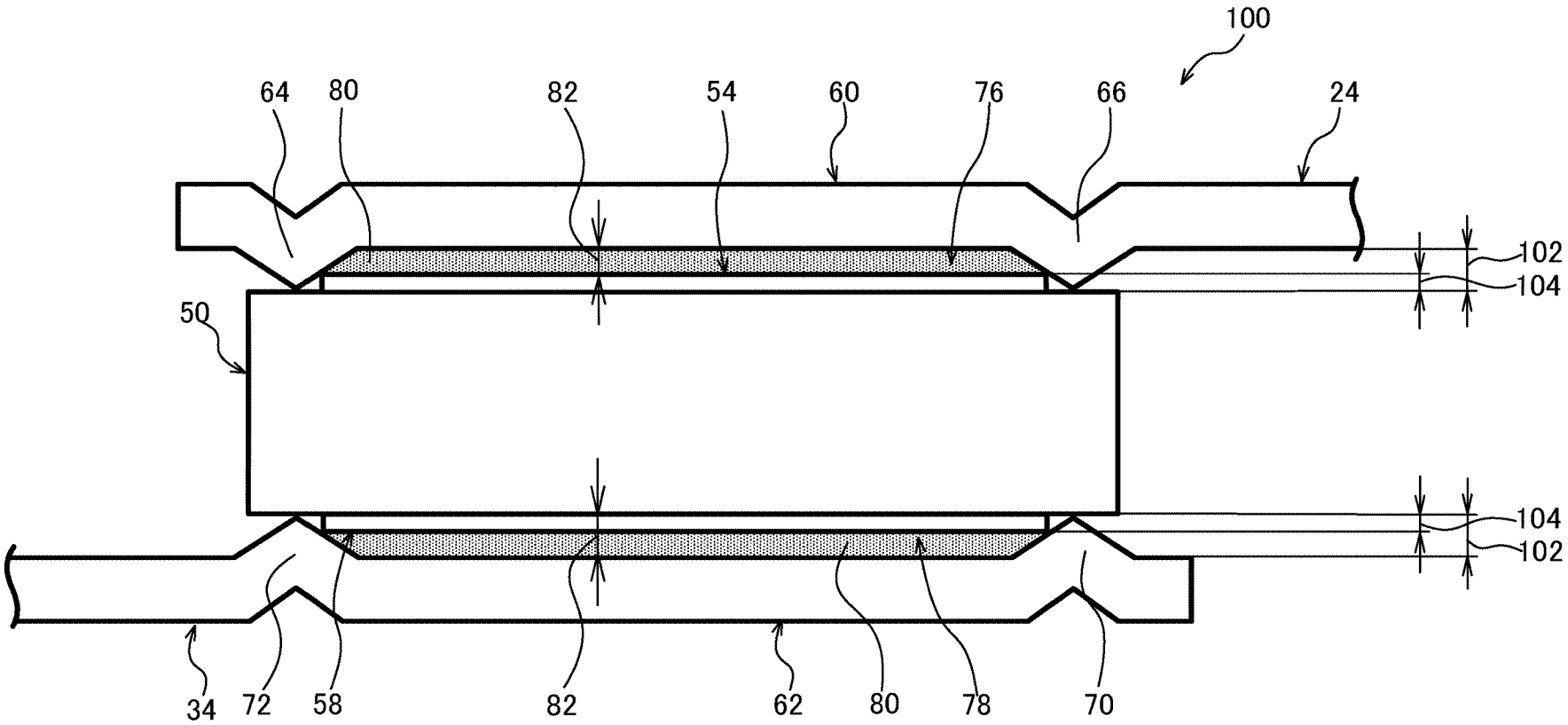
FIG. 4 is a side view showing the inside of the electronic component according to a second embodiment.

FIG. 4 is a side view showing the inside of an electronic component 100 according to the second embodiment and shows the figure corresponding to FIG. 3 for the first embodiment.

The second embodiment will be described by using FIG. 4. Components that are the same as or similar to those in the first embodiment will be assigned the same reference numerals, and a description thereof shall be omitted. Description will be given of components that are different from those in the first embodiment.

In the electronic component 100 provided with the terminal connecting structure of the second embodiment, each of the electrodes 54, 58 has a smaller external dimension compared with the first electrode 54 and the second electrode 58 of the first embodiment. Therefore, the projected portions 64, 66, 70, 72 formed on the respective terminals 24, 34 each comes into contact with the element 50 at an outer circumferential portion of each of the corresponding electrodes 54, 58.

In addition, the projecting dimension 102 of each of the projected portions 64, 66, 70, 72 from the corresponding connecting portions 60, 62 is larger than the thickness dimension 104 of each of the electrodes 54, 58. With such a configuration, the clearances 76, 78 are respectively formed between the connecting portions 60, 62 of the respective terminals 24, 34 and the respective corresponding electrodes 54, 58, and the height dimension of each of the clearances 76, 78 has a value obtained by subtracting the thickness dimension 104 from the projecting dimension 102.

Operations and Effects

Also in this embodiment, for the configurations that are the same as or similar to those in the first embodiment, it is possible to achieve operational advantages similar to those in the first embodiment.

In addition, in the terminal connecting structure in this embodiment, each of the projected portions 64, 66, 70, 72 is brought into contact with the element 50 at the outer circumferential portion of each of the electrodes 54, 58. In addition, the projecting dimension 102 of each of the projected portions 64, 66, 70, 72 from each of the connecting portions 60, 62 is larger than the thickness dimension 104 of each of the electrodes 54, 58.

According to such a configuration, the terminals 24, 34 do not come into direct contact with the respective corresponding electrodes 54, 58. Therefore, the thermal stress that may be caused by difference in thermal expansion between the connecting material 80 and each of the terminals 24, 34 is less likely to be applied to each of the electrodes 54, 58, and therefore, it is possible to improve the durability against the heat cycle.

The solder serving as the connecting material 80 only wets and spreads over each of the terminals 24, 34 and each of the electrodes 54, 58 and forms fillets. Therefore, the fillet having an inverted orientation relative to a conventional solder fillet is formed, in other words, the fillet having a contact angle between each of the electrodes 54, 58 and the solder of equal to or larger than 90° is formed, and thereby, the stress applied to each of the electrodes 54, 58 is alleviated.

In addition, because the contact area between each of the electrodes 54, 58 and the solder serving as the connecting material 80 is made larger, the bonding strength is increased.

Third Embodiment

Figure 5:
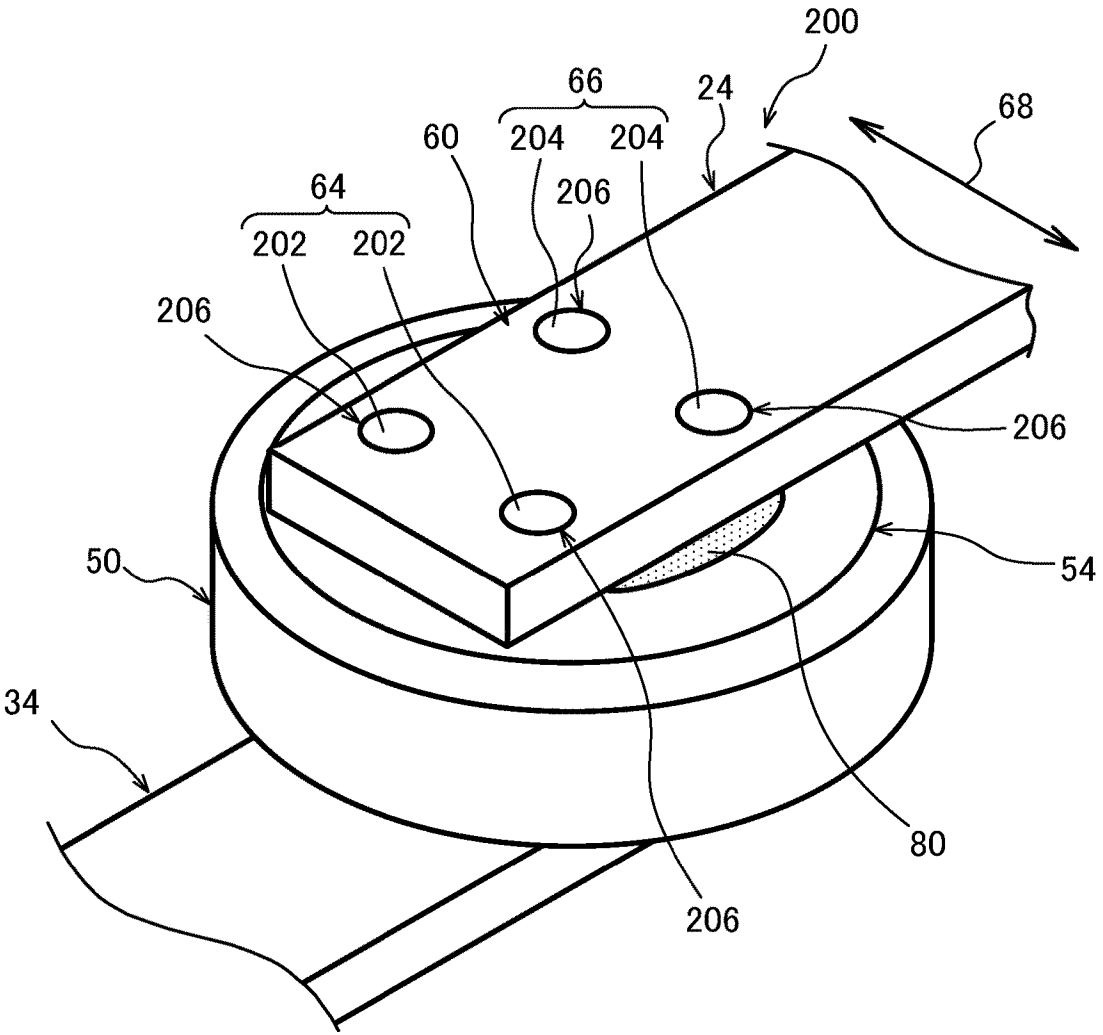
FIG. 5 is a perspective view showing the inside of the electronic component according to a third embodiment.
Figure 6:
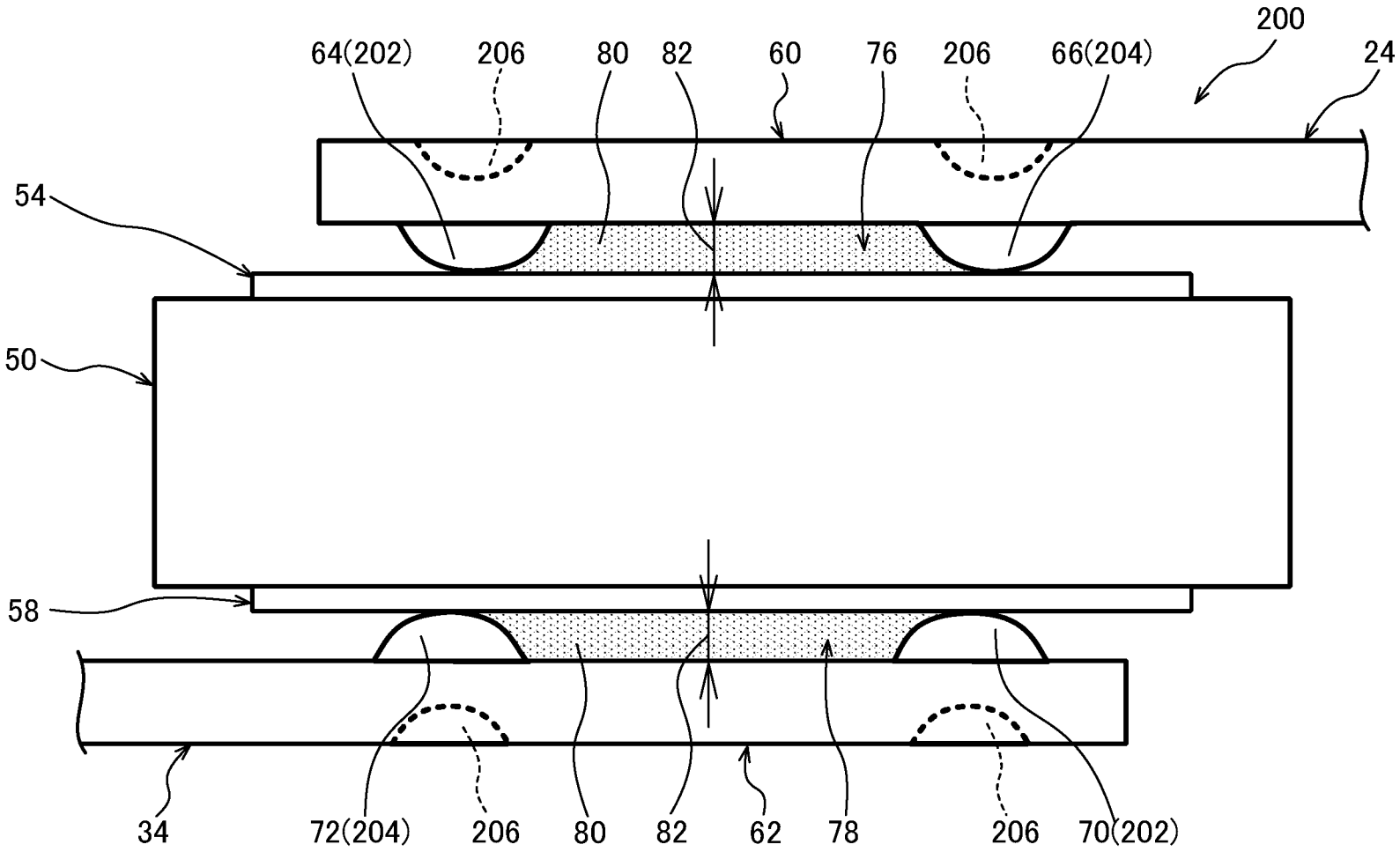
FIG. 6 is a side view showing the inside of the electronic component according to the third embodiment.

FIG. 5 is a perspective view showing the inside of an electronic component 200 according to a third embodiment and shows the figure corresponding to FIG. 2 for the first embodiment. FIG. 6 is a side view showing the inside of the electronic component 200 according to the third embodiment and shows the figure corresponding to FIG. 3 for the first embodiment.

The third embodiment will be described by using these FIGS. 5 and 6. Components that are the same as or similar to those in the first embodiment will be assigned the same reference numerals, and a description thereof shall be omitted. Description will be given of components that are different from those in the first embodiment.

In the electronic component 200 provided with the terminal connecting structure of the third embodiment, the shapes of the projected portions 64, 66, 70, 72 formed on the respective terminals 24, 34 are different compared with the first terminal 24 and the second terminal 34 in the first embodiment (see FIG. 5).

Each of the tip-end projected portions 64, 70 provided on each of the connecting portions 60, 62 of each of the terminals 24, 34 is formed by tip end bulged portions 202 that are each a part of the corresponding connecting portion 60, 62 being bulged. At least a pair of tip end bulged portions 202 are provided so as to be separated in the crossing direction 68 crossing each of the terminals 24, 34 in the width direction (see FIG. 5), and a space is formed between the tip end bulged portions 202 and 202 forming the pair.

In addition, each of the base-end projected portions 66, 72 provided on each of the connecting portions 60, 62 of each of the terminals 24, 34 is formed by base end bulged portions 204 that are each a part of the corresponding connecting portion 60, 62 being bulged. At least a pair of base end bulged portions 204 are provided so as to be separated in the crossing direction 68 crossing each of the terminals 24, 34 in the width direction, and a space is formed between the base end bulged portions 204 and 204 forming the pair.

Each of the projected portions 64, 66, 70, 72 is formed by a punching processing. In the punching processing, each of the connecting portions 60, 62 of each of the terminals 24, 34 is pressed by a punch having a hemispherical tip end so as to cause a part of each of the connecting portions 60, 62 to be pushed out. By doing so, front surfaces of the respective connecting portions 60, 62 are respectively formed with recessed portions 206 having circular shapes (see FIG. 5), and back surfaces of the respective connecting portions 60, 62 are respectively formed with the hemispherical projected portions 64, 66, 70, 72. In this embodiment, although the projected portions 64, 66, 70, 72 respectively come into contact with the electrodes 54, 58, similarly to the configuration in the second embodiment, the projected portions 64, 66, 70, 72 may respectively come into contact with the outer circumferential portions of the respective electrodes 54, 58 of the element 50.

Operations and Effects

Also in this embodiment, for the configurations that are the same as or similar to those in the first embodiment, it is possible to achieve operational advantages similar to those in the first embodiment.

In addition, in the terminal connecting structure in this embodiment, the projected portions 64, 66, 70, 72 respectively include the bulged portions 202, 204 each of which is formed with a part of each of the connecting portions 60, 62 being bulged. The bulged portions 202, 204 respectively form the clearances with the connecting portions 60, 62 of the respective terminals 24, 34.

According to such a configuration, because each of the projected portions 64, 66, 70, 72 can be formed by performing the punching processing on each of the connecting portions 60, 62, it is possible to perform the processing easier.

In addition, in the terminal connecting structure in this embodiment, a plurality of the bulged portions 202 and a plurality of the bulged portions 204 are respectively provided so as to be separated in the crossing directions 68 crossing the respective terminals 24, 34.

According to such a configuration, it is possible to respectively form spaces between the bulged portions 202 and between the bulged portions 204 arranged in the crossing direction 68. Therefore, even when the connecting material 80 is filled into each of the clearances 76, 78 in an excessive amount, it is possible to allow the excess connecting material 80 to escape in the longitudinal direction of each of the terminals 24, 34 via the a space between the respective bulged portions 202 and a space between the respective bulged portions 204.

Therefore, even when the filled amount of the connecting material 80 is excessive, it is possible to maintain the amount the connecting material 80 to be provided on each of the electrodes 54, 58 at the suitable level.

Fourth Embodiment

Figure 7:
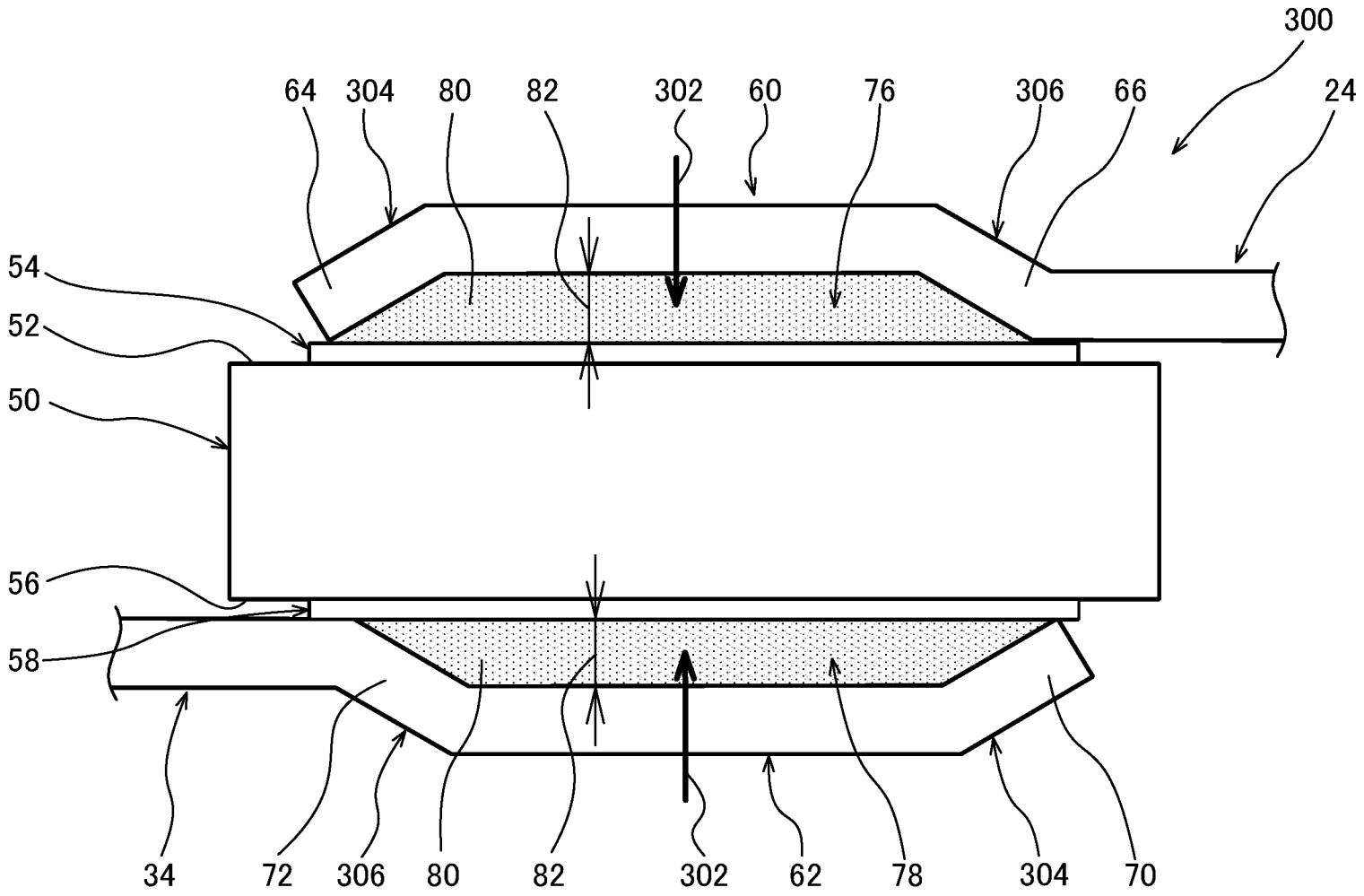
FIG. 7 is a side view showing the inside of the electronic component according to a fourth embodiment.

FIG. 7 is a side view showing the inside an electronic component 300 according to a fourth embodiment and shows the figure corresponding to FIG. 3 for the first embodiment.

The fourth embodiment will be described by using FIG. 7. Components that are the same as or similar to those in the first embodiment will be assigned the same reference numerals, and a description thereof shall be omitted. Description will be given of components that are different from those in the first embodiment.

In the electronic component 300 provided with the terminal connecting structure of the fourth embodiment, the projected portions 64, 66, 70, 72 respectively formed on the terminals 24, 34 have different configuration compared with the first terminal 24 and the second terminal 34 of the first embodiment.

Tip end portions of the respective connecting portions 60, 62 are respectively formed with tip-end bent portions 304 that are respectively formed by obliquely bending the end portions of the respective connecting portions 60, 62 by a bending processing in the direction 302 approaching the element 50. The tip-end bent portions 304 respectively form tip-end projected portions 64, 70 extending out towards the corresponding electrodes 54, 58.

In addition, on the base end side of the connecting portions 60, 62, base-end bent portions 306 are respectively formed by being obliquely bent by the bending processing in the direction 302 approaching the element 50. The base-end bent portions 306 respectively form base-end projected portions 66, 72 extending out towards the corresponding electrodes 54, 58.

In the above configuration, a part of the terminals 24, 34 extending outwards of the component main body 12 from each of the base-end projected portions 66, 72 extends in parallel with respect to each of the surfaces 52, 56 of the element 50.

In such a configuration, the clearances 76, 78 having a trapezoid shape, when viewed from the side, are respectively formed between the connecting portions 60, 62 of the respective terminals 24, 34 and the respective corresponding electrodes 54, 58.

In this embodiment, although the clearances 76, 78 are respectively formed between the connecting portions 60, 62 of the respective terminals 24, 34 and the respective corresponding electrodes 54, 58 so as to have a trapezoid shape, when viewed from the side, the present invention is not limited thereto. For example, the tip end portions and the base end portions of the respective connecting portions 60, 62 may be bent vertically (perpendicularly) such that the clearances 76, 78 are respectively formed between the connecting portions 60, 62 of the respective terminals 24, 34 and the respective corresponding electrodes 54, 58 so as to have a rectangular shape when viewed from the side. Alternatively, by respectively making the tip-end bent portions 304, 304 closer to the base-end bent portions 306, 306, it is possible to form the respective clearances 76, 78 between the connecting portions 60, 62 of the respective terminals 24, 34 and the respective corresponding electrodes 54, 58 so as to have the triangular shape when viewed from the side.

Operation and Effects

Also in this embodiment, for the configurations that are the same as or similar to those in the first embodiment, it is possible to achieve operational advantages similar to those in the first embodiment.

In addition, in the terminal connecting structure in this embodiment, the projected portions 64, 66, 70, 72 respectively have the bent portions 304, 306 that are formed by bending the end portions of the connecting portions 60, 62 in the direction 302 approaching the element 50.

According to such a configuration, because the respective projected portions 64, 66, 70, 72 can be formed by performing the bending processing on the connecting portions 60, 62, it is possible to perform the processing easier.

In addition, by changing the lengths of the respective bent portions 304, 306 or the bent angles of the respective bent portions 304, 306, it is possible to adjust the height dimensions of the clearances 76, 78. By doing so, it is possible to increase the thickness dimension 82 of the connecting material 80 to be filled into each of the clearances 76, 78 compared with the cases in the first embodiment to the third embodiment.

Fifth Embodiment

Figure 8:
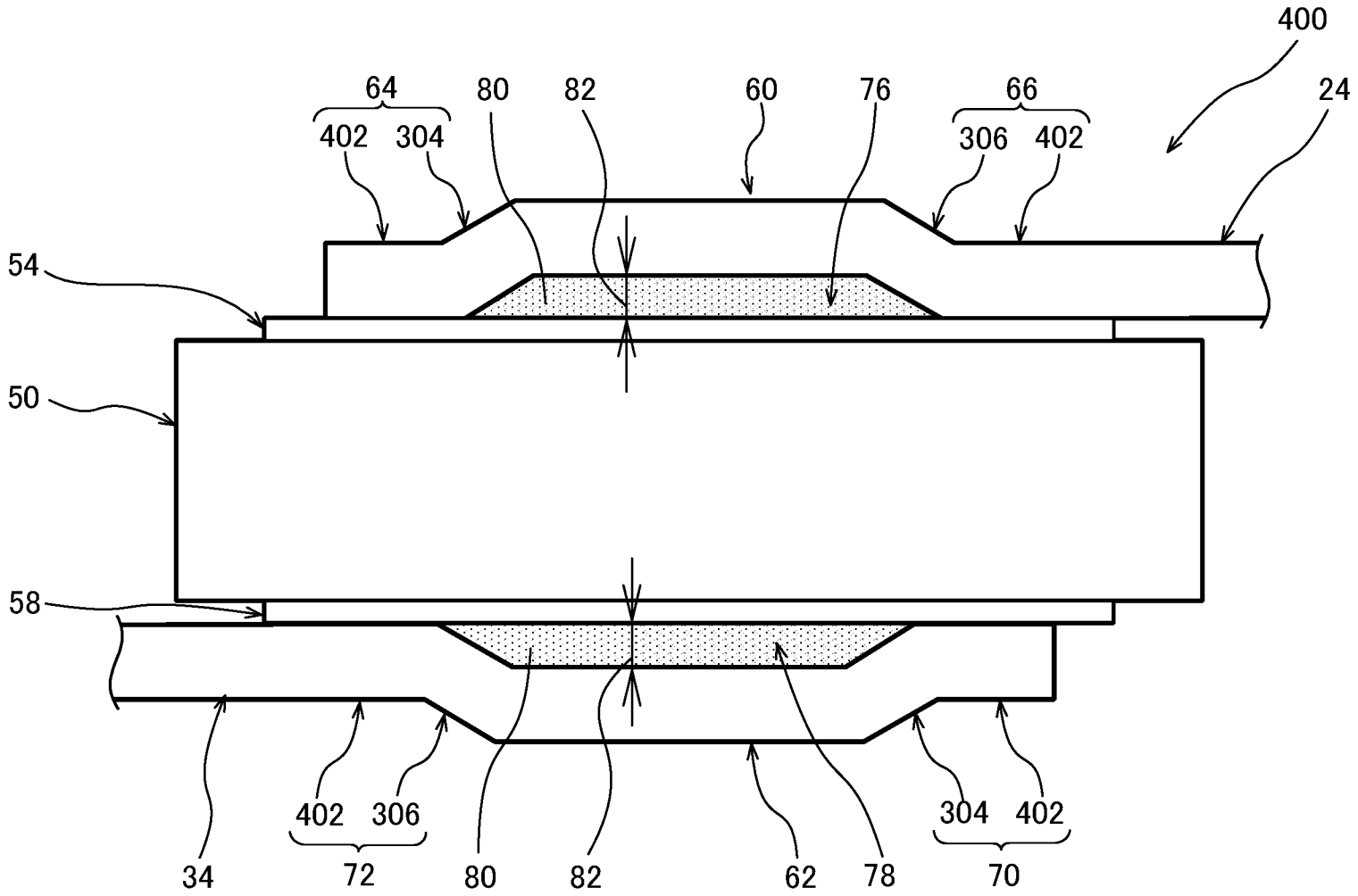
FIG. 8 is a side view showing the inside of the electronic component according to a fifth embodiment.

FIG. 8 is a side view showing the inside of an electronic component 400 according to a fifth embodiment and shows the figure corresponding to FIG. 3 for the first embodiment.

The fifth embodiment will be described by using FIG. 8. Components that are the same as or similar to those in the first embodiment and the fourth embodiment will be assigned the same reference numerals, and a description thereof shall be omitted. Description will be given of components that are different from those in the first embodiment and the fourth embodiment.

In the electronic component 400 provided with the terminal connecting structure of the fifth embodiment, the projected portions 64, 66, 70, 72 formed on the respective terminals 24, 34 are different compared with the first terminal 24 and the second terminal 34 of the first embodiment and the fourth embodiment.

In other words, the projected portions 64, 66, 70, 72 respectively formed on the connecting portions 60, 62 of the respective terminals 24, 34 are provided with extended portions 402 respectively extending from the bent portions 304, 306 along the element 50. The extended portions 402 respectively extend so as to be in parallel with the corresponding electrodes 54, 58, and the extended portions 402 are formed so as to respectively come into contact with the corresponding electrodes 54, 58. The bent portions 304, 306 respectively form the clearances with the connecting portions 60, 62 of the respective terminals 24, 34.

Tip ends of the extended portions 402 of the respective projected portions 66, 72 respectively formed on the base end sides of the connecting portions 60, 62 extend outwards of the component main body 12.

Operations and Effects

Also in this embodiment, for components that are the same as or similar to those in the first embodiment and the fourth embodiment, it is possible to achieve operational advantages similar to those in the first embodiment and the fourth embodiment.

In addition, in the terminal connecting structure in this embodiment, the projected portions 64, 66, 70, 72 are respectively provided with the extended portions 402 respectively extending from the bent portions 304, 306 along the element 50.

According to such a configuration, because each of the projected portions 64, 66, 70, 72 can be formed by performing the press work on the connecting portions 60, 62, it is possible to perform the processing easier.

In addition, in the respective projected portions 64, 66, 70, 72, the extended portions 402 are respectively in contact with the electrodes 54, 58. Therefore, compared with the fourth embodiment, the contact areas between the terminals 24, 34 and the respective corresponding electrodes 54, 58 are increased. With such a configuration, because the arranged state in which the terminals 24, 34 are respectively arranged on the corresponding electrodes 54, 58 can be stabilized, the connection operation with the connecting material 80 becomes easier.

In any of the above-described embodiments, depending on applications or required performances, the component main body 12 formed of the molding resin may not be present, or a protecting film formed of epoxy resin, etc. may be used in place of the component main body 12.

Furthermore, although the projected portions 64, 66, 70, 72 respectively formed on the terminals 24, 34 are configured such that the tip-end projected portions 64, 70 and the base-end projected portions 66, 72 form pairs, respectively, the present invention is not limited thereto. For example, projected portions may respectively be provided between the tip-end projected portions 64, 70 and the base-end projected portions 66, 72, and more than one projected portions may be provided.

Although the embodiments of the present invention have been described in the above, the above-mentioned embodiments merely illustrate a part of application examples of the present invention, and the technical scope of the present invention is not intended to be limited to the specific configurations in the above-mentioned embodiments.

This application claims priority based on Japanese Patent Application No. 2020-156249 filed with the Japan Patent Office on Sep. 17, 2020, the entire contents of which are incorporated into this specification by reference.

What is claimed is:

1. A terminal connecting structure comprising:

an electrode provided on an element forming a component;

a terminal having a connecting portion arranged along the electrode;

a clearance forming portion configured to form a clearance between the electrode and the connecting portion; and a connecting material provided in the clearance, the connecting material being configured to electrically connect the connecting portion and the electrode, wherein the clearance forming portion includes a projected portion projected from the connecting portion, and the projected portion includes a ridge crossing the terminal.

2. The terminal connecting structure according to claim 1, wherein the projected portion includes a bent portion, the bent portion being formed by bending an end portion of the connecting portion in a direction approaching the element.

3. The terminal connecting structure according to claim 2, wherein the projected portion includes an extended portion extending from the bent portion along the element.

4. The terminal connecting structure according to claim 1, wherein the projected portion is in contact with the element at an outer circumferential portion of the electrode, and the projected portion has a projecting dimension from the connecting portion, the projecting dimension being larger than a thickness dimension of the electrode.

5. An electronic component having the terminal connecting structure according to claim 1.

6. The electronic component according to claim 5, wherein the electrode includes a first electrode and a second electrode, the first electrode being provided on a first surface of the element, and the second electrode being provided on a second surface of the element, and the terminal includes a first terminal and a second terminal, the first terminal being electrically connect to the first electrode, and a second terminal being electrically connect to the second electrode.

7. The electronic component according to claim 6, wherein the element is a ceramic element forming a varistor.

* * * * *